United States Patent [19]

Matsuo

[11] 4,448,298

[45] May 15, 1984

[54] ROTARY TROUGH TYPE COOLING BED RUN-IN APPARATUS

[75] Inventor: Giichi Matsuo, Tokyo, Japan

[73] Assignee: Nippon Kokan Kabushiki Kaisha, Tokyo, Japan

[21] Appl. No.: 456,799

[22] Filed: Jan. 10, 1983

Related U.S. Application Data

[63] Continuation-in-part of Ser. No. 219,377, Dec. 22, 1980, abandoned.

[30] Foreign Application Priority Data

Dec. 26, 1979 [JP] Japan ..... 54-168079

[51] Int. Cl.[3] ..... B65G 47/26

[52] U.S. Cl. ..... 198/451; 198/452; 414/748

[58] Field of Search ..... 198/448, 451, 491, 492, 198/530, 531, 532, 774, 775, 776, 452; 221/263, 266; 414/745, 748

[56] References Cited

U.S. PATENT DOCUMENTS 2,535,648 12/1950 Mills ..... 221/263

2,813,615 11/1957 Klein ..... 198/531 X 4,173,211 11/1979 Crawford ..... 221/266

4,261,456 4/1981 Scarpa et al. ..... 198/491 X

FOREIGN PATENT DOCUMENTS 771143 3/1957 United Kingdom ..... 198/491

*Primary Examiner*—Joseph E. Valenza

*Assistant Examiner*—Jonathan D. Holmes

*Attorney, Agent, or Firm*—Joseph W. Molasky & Assocs.

[57] ABSTRACT

There is described a rotary trough type cooling bed run-in apparatus for dropping the roll bars of a steel round bar mill onto a cooling bed in an aligned state at high speed and absent the warpage associated with similar devices. Several troughs each having a longitudinal opening and an axial opening are rotatably mounted. A roll bar is introduced axially into each of said troughs following which said opening is closed off by a cover to ensure that said bar will not be prematurely ejected. As said troughs move downwardly said covers are simultaneously removed to expose the enclosed bars and these are allowed to fall downwardly onto a cooling bed.

11 Claims, 6 Drawing Figures

ROTARY TROUGH TYPE COOLING BED RUN-IN APPARATUS

This is a continuation-in-part of applicants' copending application Ser. No. 219,377, filed Dec. 22, 1980, now abandoned.

The present invention relates to a rotary trough type cooling bed run-in apparatus employed for guiding a small steel round bar rolled by a merchant bar mill to the upper input side of a cooling bed and allowing the bar to drop in aligned state on the cooling bed.

A known cooling bed run-in apparatus employed with a merchant bar mill includes a plurality of angle troughs each composed of an angle bar and arranged in rows corresponding to the number of the strands and ejecting levers which are assembled to the angle troughs in their line direction at equal spaces, whereby the levers are rotated and the rolled bars are ejected from the angle troughs onto a cooling bed to cool and straighten the bars. In this case, in consideration of the combination with the ejecting levers, the angle troughs are arranged in rows and in inclined relation and the number of the troughs is for example two in the case of a single-strand mill and four in the case of a two-strand mill, whereby the bar ejected from the angle trough rolls down the chute projected from the trough and falls into the first groove of the cooling bed. However, this prior art apparatus is disadvantageous in that each of the troughs is formed with an opening in its inclined upper front end so that at high speed operation of over 18 m/s the top of the bar projects and causes a bending to the bar, thus making the apparatus unsuitable for use as an attachment apparatus for high speed rolling purposes. Another disadvantage is that since the bar rolls down the chute, a wavy warpage is produced and retained in the bar even after the cooling and the pitch of the ejecting levers also has the effect on the wavy warpage. Still another disadvantage is that the time required for the bar to fall from the angle trough onto the cooling bed differs with the different troughs and consequently it is difficult to determine the proper ejection timing to eject each bar positively into one of the grooves of the cooling bed.

The present invention has been made to overcome the foregoing deficiencies in the prior art, and the invention can be more fully understood from the following detailed description taken in conjunction with the accompanying drawings, in which.

Figure 1:
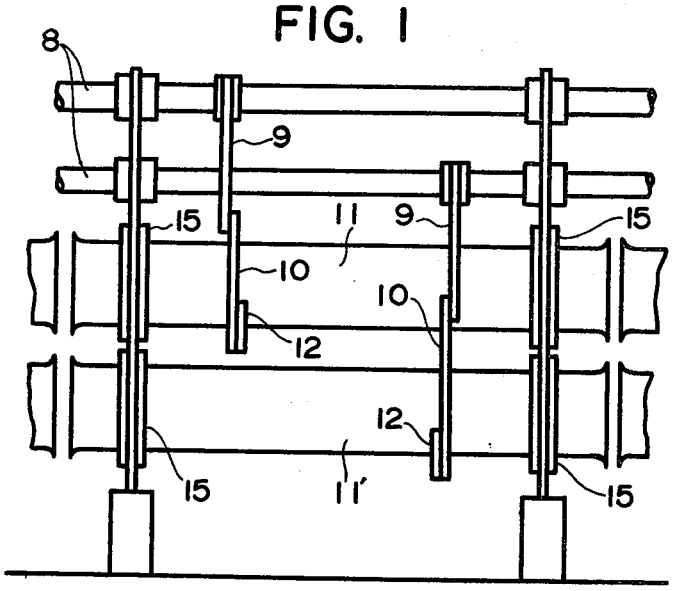
FIG. 1 is a front view showing the general construction of an apparatus according to the present invention.
Figure 2:
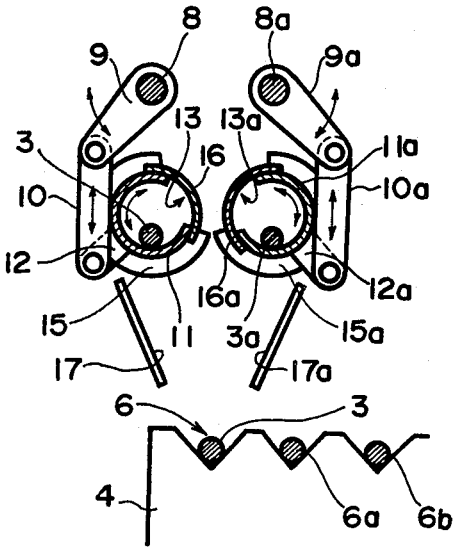
FIG. 2 is a sectional view taken along the line I—I of FIG. 1, showing the relative positions of the long troughs and the cooling bed for a single-strand bar mill in an embodiment of the invention.
Figure 3:
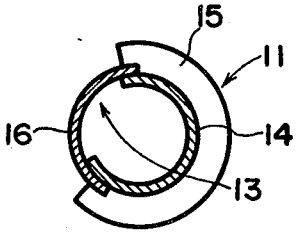
FIG. 3 is a sectional side view of an embodiment of the long trough, showing its relation with a rotary guide and a slit cover.

Referring to FIGS. 1 and 2, each of turning arms 10 is pivoted to one end of a turning lever 9 fixedly mounted on a rotatable turning shaft 8, and pivoted to the other end of the arm 10 is an arm end of a rotary arm 12 secured to a long trough 11 which will be described later, whereby the long trough 11 is rotated about its axis in response to the rotation of the turning shaft 8. As shown in FIG. 3, each of the long troughs 11 is comprised of a steel pipe 14 formed with a longitudinal slit 13 and the long trough 11 is arranged to extend parallel to the turning shaft 8. A rotary guide 15 having a lateral opening extending in the same direction as the slit 13 is secured to each of the ends of the trough 11, and is rotatably mounted in a fixed position to a suitable support member. A slit cover 16 is secured to the support member so as not to interfere with rotation of the long trough 11 and the guide 15. Thus, when the long trough 11 is rotated so that the slit covers 16 face the slit 13, the slit is covered. When the long trough 11 is rotated further so that the slit 13 no longer faces the slit cover 16, the slit 13 is exposed downwardly. When the number of the strands is 1, the long troughs 11 are positioned relative to a cooling bed 4 as shown in FIG. 2, that is, long troughs 11 and **11*a* are arranged symmetrically and slit covers 16 and 16*a* respectively covering the slits 13 and 13*a* are arranged in such directions that they are inwardly upwardly inclined at an angle of about 45°. As a result, when the long trough 11 and 11*a* are positioned so that the slits 13 and 13*a* respectively face the slit covers 16 and 16*a*, the slits 13 and 13*a* are covered by the slit covers 16 and 16*a*. When the long trough 11 or 11*a* is rotated so that the slit 13 or 13*a* faces downward, a rolled bar 3 or 3*a* placed in the long trough 11 or 11*a* is dropped through the slit 13 or 13*a* and the lateral opening of the rotary guide 15 or 15*a* to fall along a guide plate 17 or 17*a* into a first groove 6 of the cooling bed 4**.

In the case of the above-mentioned singlestrand bar mill, the sequence of operations of the apparatus is as follows. The rolled bar is cut to required lengths by a shear (not shown) which is located at the delivery side of the final-stage rolling mill, and a sorter (not shown) which is located at the entry side of the long troughs 11 and **11*a* introduces the first one of the bars axially into one or the other of the left and right troughs (e.g., the trough 11). Then, this bar 3 is braked and stopped in place by a brake (not shown). During the interval a second bar 3*a* is introduced into the other adjoining long trough 11*a* and the long trough 11 is rotated so that the braked first bar 3 is dropped into the first groove 6 of the cooling bed 4. Then the bar 3 in the first groove 6 is transferred to the next groove 6*a* by a transfer means comprised of a plurality of parallel walking beams (not shown) and then the second bar 3*a* is similarly stopped and dropped into the first groove 6 which is now empty. Thus, by operation of the said walking beams the rolled bar 3 or 3*a* disposed in the first groove 6 of the cooling bed 4 is transferred to the next groove 6*a* and the bar in the groove 6*a* is transferred to the following groove 6*b* and so forth. During the latter interval the next bar 3 is introduced axially into the empty long trough 11. By thus repeating the similar sequence of operations, it is possible to successively drop the succeeding bars 3 and 3*a* into the groove 6 of the cooling bed 4**.

Figure 4:
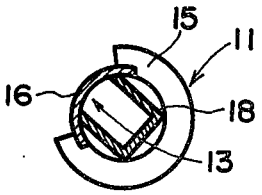
FIG. 4 is a sectional side view showing another embodiment of the long trough.

It should be apparent without any detailed description that the long trough 11 may be comprised of, in place of the steel pipe 14, an angle steel 18 of substantially U-shape as shown in FIG. 4 so as to ensure the same effect.

Figure 5:
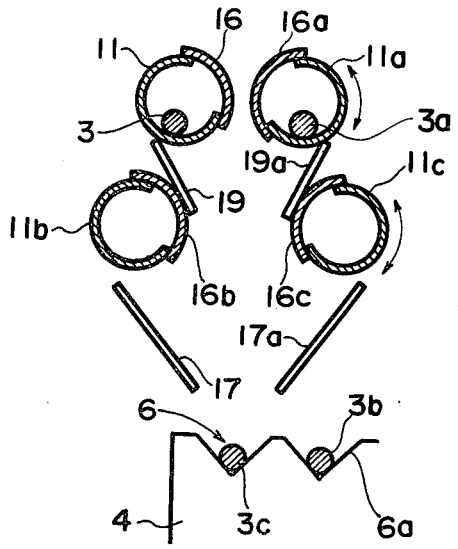
FIG. 5 is a longitudinal sectional view of another embodiment, showing the relative positions of long troughs and a cooling bed for a two-strand bar mill.

The arrangement of long troughs 11 in a second embodiment of the invention adapted for a two-strand bar mill will now be described with reference to FIG. 5. The second embodiment differs from the first embodiment in that a similar pair of long troughs 11*b* and 11*c* having a slightly wider spacing are arranged side by side below the juxtaposed long troughs 11 and 11*a* and that the similar guide plates 19 and 19*a* are arranged between the upper and lower long troughs 11, 11*a* and 11*b*, 11*c* in addition to the guide plates 17 and 17*a* which are now respectively arranged between the lower long troughs 11*b* and 11*c* and the cooling bed 4. The sequence of operations is as follows. Two bars of No. 1 strand and No. 2 strand rolled parallel to each other are introduced at a different timing into the left and right or the upper and lower long troughs by the said sorter (not shown), in order to prevent the bar from crossing, because the bars are not cut at the same time and the cutting timing is different. Thus a first bar of No. 1 strand 3 is introduced into one of the upper left and right long troughs (e.g., the trough 11) and the bar 3 is stopped by braking. During the deceleration period, a first bar of No. 2 strand 3*a* is introduced into the right long trough 11*a* and stopped by braking. The first bar 3 which has been stopped is dropped into the first groove 6 of the cooling bed 4 and then transferred to the next groove 6*a*. The second bar 3*a* is successively dropped into the now empty first groove 6 and similarly transferred to the next groove 6*a*. During the period, third and fourth bars are respectively introduced into the lower left and right long trough 11*b* and 11*c*, and dropped into the groove 6 of the cooling bed 4 by the similar sequence of operations as above-mentioned. In this way, the same process of introducing the next bar into the empty long trough while the bar in the other long trough is being braked, is performed repeatedly and the bars are successively dropped into the groove of the cooling bed 4.

Figure 6:
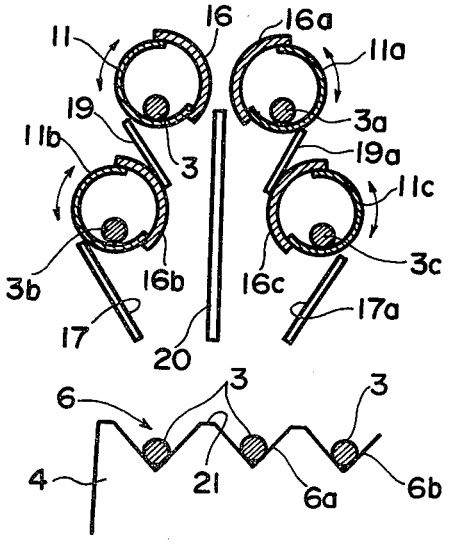
FIG. 6 is a longitudinal sectional view of still another embodiment, showing the relative positions of long troughs and a cooling bed for a multiple stranded bar produced by slitting a rolled billet.

Referring to FIG. 6 showing another embodiment of the invention applied to a billet rolling with two-piece slitting, the arrangement of long troughs 11 is all the same with that of the previously described two-strand bar mill but an isolation partition 20 is vertically arranged between the left and right long troughs 11, 11*b* and 11*a*, 11*c*, and the cooling bed 4 is positioned such that the lower end of the isolation partition 20 is pointed toward the crest portion between the adjacent grooves of the cooling bed 4. This embodiment is also designed so that the two bar 3, 3*a* dropped at the same time into the groove 6 of the cooling bed 4 are subjected to continuous two-groove or by double pitch transfer. This is because two-piece slit bars are cut simultaneously by a shear (not shown) in a rolled billet and hence the bars must be introduced simultaneously into the left and right long troughs. In operation, the first bars 3, 3*a* are introduced simultaneously into the left and right long troughs of the upper or lower row (e.g., the trough 11, 11*a*) and then the second bars 3*b*, 3*c* are introduced into the long trough 11*b*, 11*c* of the other row while braking the first bars 3, 3*a*. Then the stopped first bars 3, 3*a* are dropped respectively into the groove 6, 6*a* of the cooling bed 4 and subjected to the continuous two-groove transfer as mentioned above. Then, the next bars 3, 3*a* are introduced into the empty trough 11, 11*a* while braking the second bars 3*b*, 3*c*. The second bars 3*b*, 3*c* are dropped in the same manner into the cooling bed 4 and transferred. Thereafter the same process is repeated alternately for the upper and lower troughs. The apparatus shown in FIG. 6 may be applied to two-strand rolling. In this case, it is only necessary that two-strand bars are stopped and then dropped simultaneously. In the case of a multiple stranded bar with three-piece slitting or over, it is only necessary to provide the same number of rows of the upper and lower long troughs as the number of pieces slit at a time.

It will thus be seen from the foregoing description that in accordance with the present invention, by virtue of the fact that the introduction of a bar into the long trough 11 is effected while its slit 13 is being covered by slit covers 16, it is possible to ensure a high speed rolling of over 20 m/s and greatly reduce the occurrence of ejection or bending of the bar. Further, due to the fact that the bar 3 is dropped over a very short distance into the groove 6 of the cooling bed 4 through the slit 13 opened downwardly by the rotation of the long trough 11, there is no danger of causing a wavy warpage in the bar during its dropping and the time required for dropping is reduced due to the reduced dropping distance. Still further, due to the reduced time difference in dropping of the bars from the long troughs, the timing of dropping of bars can be easily adjusted. Still further, due to the fact that the bar is dropped by gravity fall due to the rotation of the long trough instead of the ejection operation performed by the rotation of the levers as in the prior art apparatus, the length of the long troughs can be selected for example in the range of 4 to 6 m. This length is about 10 times the conventional length of 0.6 to 0.6 m. Where the two-strand four-trough type is applied to the two-strand bar which is slit a rolled billet, the bars are slit simultaneously and consequently if the upper two long troughs and the lower two long troughs are alternately and simultaneously rotated to effect the simultaneous dropping, the timing of dropping can be controlled in the same manner as in the case of the single-strand bar mill, thus providing a sufficient processing time.

As mentioned above, the present invention is very useful industrially in that the rolling of small steel rounds can be effected at high speed, that there is no danger of causing wavy warpage, that the timing of dropping can be adjusted easily and so on.

What is claimed is:

1. In a rotary trough type cooling bed run-in apparatus employed for guiding a small round bar rolled by a merchant bar mill to the upper input side of a cooling bed and allowing the bar to drop in an aligned state on the cooling bed, the combination comprising:

a plurality of rotatably mounted long troughs open at each end and arranged in serial fashion, each having a longitudinal slit and each being adapted to receive a product bar axially;

a plurality of rotary guide means secured lengthwise to each of said long troughs each having a lateral opening extending in the same direction as said slit;

fixed support means for rotatably supporting each of said long troughs through said guide means;

a slit cover secured to said support means without interfering with the rotation of said long troughs and said guide means, whereby, in response to the rotation of each of said long troughs said slit is covered when said slit faces said slit covers and said slit is uncovered when said slit is not facing said slit covers; and a cooling bed having a plurality of grooves disposed below said long troughs, whereby, the product bar dropped from each of said long troughs through said slit is received in one of said grooves.

2. An apparatus according to claim 1, further comprising a turning shaft disposed parallel to each of said long troughs, and lever means connected to the outer periphery of said long trough and said turning shaft for setting said long trough in rotation.

3. An apparatus according to claim 1, wherein each of said long trough is comprised of a steel pipe.

4. An apparatus according to claim 1, wherein each of said long troughs is comprised of an angle of substantially U-shape.

5. An apparatus according to claim 1, further comprising a pair of long troughs arranged at opposed lateral positions to define a predetermined space therebetween, and a pair of slit covers arranged at opposed lateral positions and inclined upwardly to the inside of said long troughs.

6. An apparatus according to claim 5, further comprising a second pair of long troughs arranged at opposed lateral positions below a first pair of long troughs to define a space therebetween which is greater than that of said first pair.

7. An apparatus according to claim 5, wherein a plurality of pairs of long troughs are arranged in rows below said first pair such that the spacing of each of said pairs is smaller than the spacing of one of said pairs just below thereof.

8. An apparatus according to claim 5, further comprising a pair of opposed guide plates arranged between said pair of long troughs in the lowest row and said cooling bed and adapted for guiding the bar towards a row of grooves on said cooling bed in the course of dropping from each of said long troughs.

9. An apparatus according to claim 8, further comprising a pair of opposed guide plates arranged between said pairs of long troughs arranged in rows such that the bar is guided along the inner side of the lower long troughs in the course of dropping of the bar from the upper long trough.

10. An apparatus according to claim 9, wherein an isolation partition is vertically arranged between said long troughs arranged at opposed lateral positions such that the lower end of said partition is substantially aligned with a crest portion between two of said grooves of said cooling bed.

11. An apparatus according to claim 10, wherein said cooling bed is adapted for the multi-groove transfer of product bars.

* * * * *